US010066457B2

(12) United States Patent
Nguyen

(10) Patent No.: US 10,066,457 B2
(45) **Date of Patent: *Sep. 4, 2018**

(54) HYDRAULIC TOOL

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/620,697

(22) Filed: Jun. 12, 2017

(65) Prior Publication Data

US 2017/0370177 A1 Dec. 28, 2017

Related U.S. Application Data

(63) Continuation of application No. 14/677,771, filed on Apr. 2, 2015, now Pat. No. 9,677,374.

(51) Int. Cl.
*E21B 23/04* (2006.01)
*E21B 33/02* (2006.01)
*E21B 33/128* (2006.01)

(52) U.S. Cl.
CPC ..... *E21B 33/1285* (2013.01); *E21B 23/04* (2013.01); *E21B 33/02* (2013.01)

(58) Field of Classification Search
CPC ..... E21B 23/04; E21B 33/02; E21B 33/04; E21B 33/043; E21B 33/1285
See application file for complete search history.

(56) References Cited

U.S. PATENT DOCUMENTS 3,693,714 A * 9/1972 Baugh ..... E21B 33/047 166/348
3,907,001 A * 9/1975 Vanderlaan ..... F04B 9/125 137/116.5
3,924,678 A * 12/1975 Ahlstone ..... E21B 33/043 166/120
5,174,376 A * 12/1992 Singeetham ..... E21B 33/043 166/182
6,006,647 A * 12/1999 Van Winkle ..... E21B 33/062 91/41
6,260,817 B1 * 7/2001 Lam ..... E21B 33/062 251/1.3
7,096,956 B2 * 8/2006 Reimert ..... E21B 23/04 166/339
9,217,307 B2 * 12/2015 McCoy, Jr. ..... E21B 33/043
9,677,374 B2 * 6/2017 Nguyen ..... E21B 33/1285
2016/0010404 A1 * 1/2016 Nguyen ..... E21B 19/10 166/77.51

* cited by examiner

*Primary Examiner* — Matthew R Buck
(74) *Attorney, Agent, or Firm* — Fletcher Yoder, P.C.

(57) ABSTRACT

A system including a hydraulic tool configured to energize a lock ring system and a seal assembly with a hydraulic fluid, wherein the hydraulic tool including a hydraulic body configured to couple to a hydraulic fluid source, a first piston configured to move axially with respect to the hydraulic body to energize the seal assembly, and a second piston configured to move axially with respect to the hydraulic body to energize the lock ring system, wherein the first and second pistons are simultaneously exposed to the hydraulic fluid in an opening in the hydraulic body.

20 Claims, 7 Drawing Sheets

119
117
118
116
27
88
30
87
110
78
108
28
96
100
104
102
92
94
90
98
98
132
50
5
5
22
154
120
52
56
58
200
54
60
36
26
34
70
72
122

27
119
117
118
116
88
88
30
86
87
110
28
78
96
104
102
92
94
90
74
7
50
132
164
84
7
120
22
154
52
58
56
200
54
60
36
26
34
70
72
122

HYDRAULIC TOOL

CROSS REFERENCE TO RELATED APPLICATION

This application is a continuation of U.S. patent application Ser. No. 14/677,771, entitled "HYDRAULIC TOOL," filed Apr. 2, 2015, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In some drilling and production systems, hangers, such as a tubing hanger, may be used to suspend strings of tubing for various flows in and out of the well. Such hangers may be disposed within a wellhead that supports both the hanger and the string. For example, a tubing hanger may be lowered into a wellhead and supported therein. To facilitate the running or lowering process, the tubing hanger may couple to a tubing hanger-running tool (THRT). Once the tubing hanger has been lowered into position within the wellhead by the THRT, a seal is formed in the gap between the spool and the hanger to block fluid flow. Unfortunately, existing systems used to seal the gap between the spool and the hanger may be complicated and time consuming.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a hydrocarbon extraction system with a hydraulic tool capable of energizing a seal assembly and lock ring system with one fluid line/string. As will be explained below, the fluid line/string couples to a hydraulic body containing a first and second piston. The first and second pistons rest within the same opening of the hydraulic body and are therefore simultaneously exposed to the same hydraulic fluid pressure. However, the first and second pistons have differently sized surface areas exposed to hydraulic fluid and therefore the first and second pistons may be actuated independently. For example, the second piston may have surface area smaller than the first piston. Accordingly, a first hydraulic fluid pressure may produce more force on the second piston than on the first piston, thus driving the second piston and not the first piston. After driving the second piston, the hydraulic carbon extraction system may increase the fluid pressure to a second hydraulic fluid pressure that then drives first piston. By actuating the pistons separately, the hydraulic tool can set a seal assembly, and while holding the seal assembly in an energized state, drive a lock ring system to lock the seal assembly in the set position.

Figure 1:
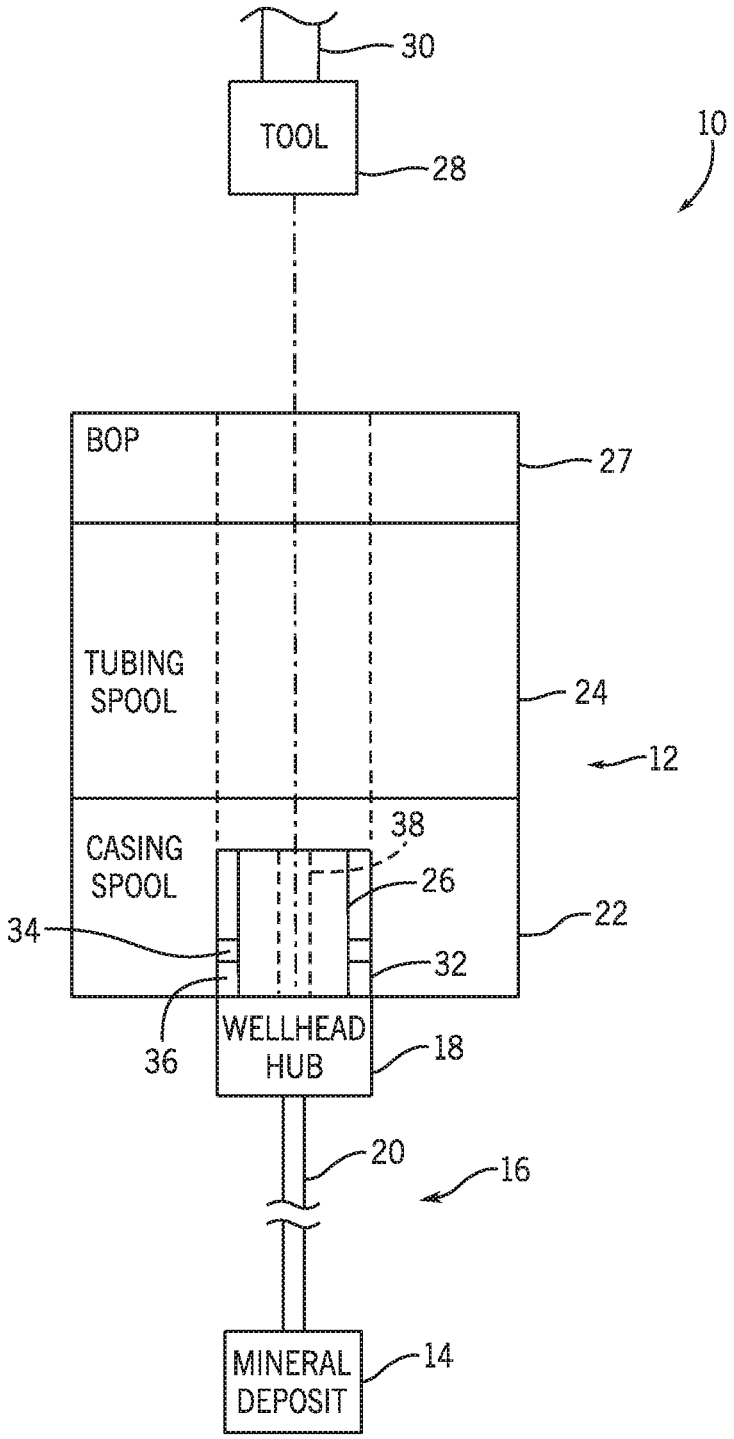
FIG. 1 is a block diagram of an embodiment of a mineral extraction system with a hydraulic tool.

FIG. 1 is a block diagram that illustrates a hydrocarbon extraction system 10 according to an embodiment. The illustrated hydrocarbon extraction system 10 can be configured to extract various minerals and natural resources, including hydrocarbons (e.g., oil and/or natural gas), or configured to inject substances into the earth. In some embodiments, the hydrocarbon extraction system 10 is land-based (e.g., a surface system) or subsea (e.g., a subsea system). As illustrated, the hydrocarbon extraction system 10 includes a wellhead 12 coupled to a mineral deposit 14 via a well 16, wherein the well 16 includes a wellhead hub 18 and a well-bore 20.

The wellhead hub 18 generally includes a large diameter hub that is disposed at the termination of the well-bore 20. The wellhead hub 18 provides for the connection of the wellhead 12 to the well 16. The wellhead 12 typically includes multiple components that control and regulate activities and conditions associated with the well 16. For example, the wellhead 12 includes a spool 22 (e.g., tubular), a tubing spool 24 (e.g., tubular), a hanger 26 (e.g., a tubing hanger or a casing hanger), a blowout preventer (BOP) 27 and a "Christmas" tree. However, the system 10 may include other devices that are coupled to the wellhead 12, and devices that are used to assemble and control various components of the wellhead 12. For example, the hydrocarbon extraction system 10 includes a hydraulic tool 28 suspended from a fluid line/string 30 (e.g., drill string) that locks and/or seals components within the wellhead 12.

As illustrated, the casing spool 22 defines a bore 32 that enables fluid communication between the wellhead 12 and the well 16. Thus, the casing spool bore 32 may provide access to the well bore 20 for various completion and workover procedures. For example, the tubing hanger 26 can be run down to the wellhead 12 and disposed in the casing spool bore 32. In operation, the hanger 26 (e.g., tubing hanger or casing hanger) provides a path (e.g., hanger bore 38) for chemical injections, etc. As illustrated, the hanger bore 38 extends through the center of the hanger 26 enabling fluid communication with the tubing spool bore 32 and the well bore 20. As will be appreciated, the well bore 20 may contain elevated pressures. Accordingly, hydrocarbon extraction systems 10 employ various mechanisms, such as seals, plugs, and valves, to control and regulate the well 16. For example, the hydrocarbon extraction system 10 may include a seal assembly 34 (e.g., annular multi-metal seal system) in a space 36 (e.g., annular region) between the tubing hanger 26 and the casing spool 22 that blocks fluid flow through the space 36.

Figure 2:
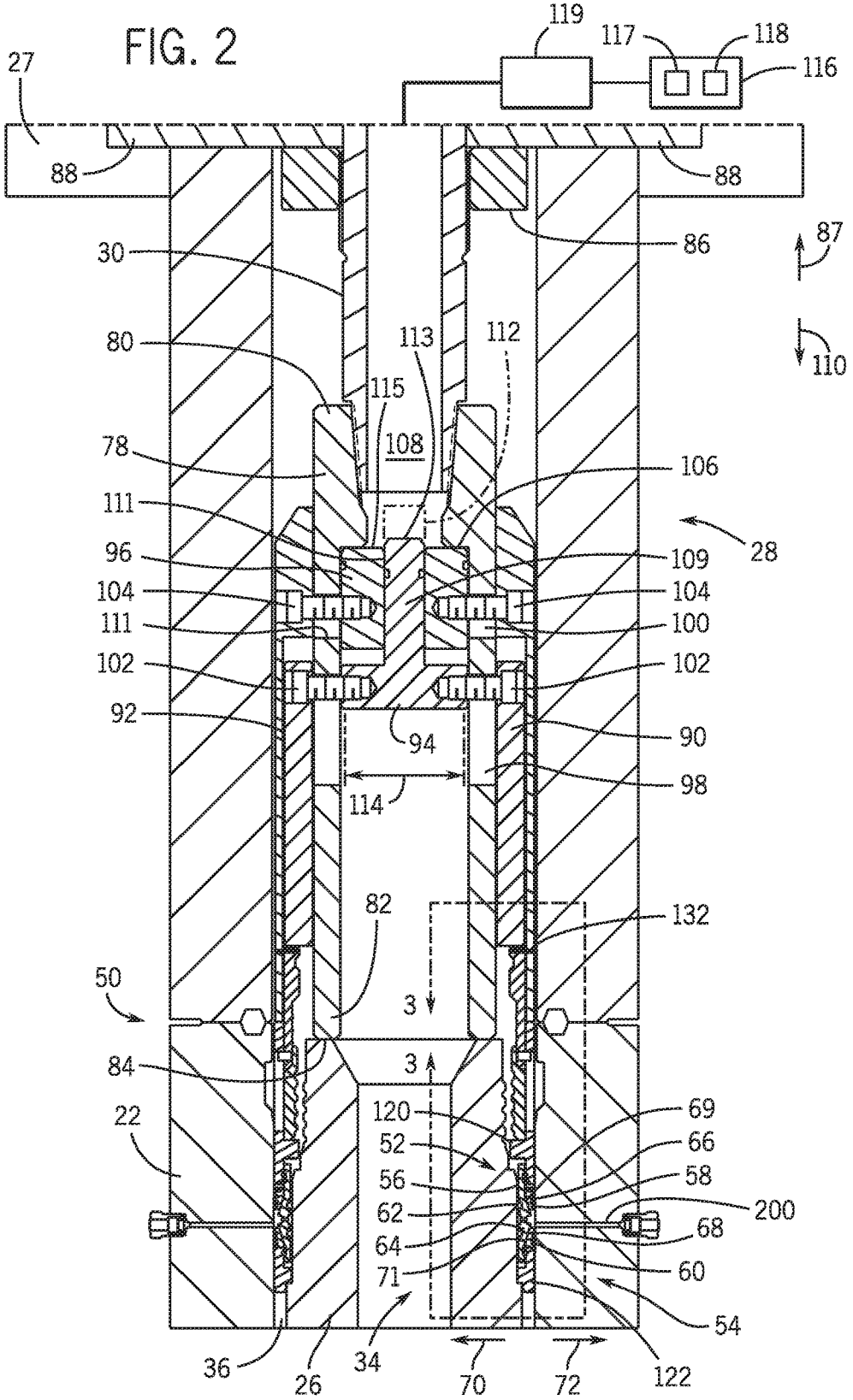
FIG. 2 is a cross-sectional side view of an embodiment of a hydraulic tool in an unenergized state.

FIG. 2 is a cross-sectional side view of an embodiment of a hydraulic tool 28 and the seal assembly 34 in an unenergized state. As explained above, the hydrocarbon extraction system 10 may include various seals, plugs, etc. that control the flow of fluid into and out of the well 16. For example, the seal assembly 34 may form first and second seals 52 and 54 (e.g., annular seals) in the space 36 between the tubing hanger 26 and the casing spool 22. As illustrated, the first and second seals 52, 54 are axially spaced from one another between the spool 22 and the hanger 26. The first seal 52 is formed with a first metal seal portion 56 and a second metal seal portion 58, while the second seal 52 is formed with first metal seal portion 56 and a third metal seal portion 60. These metal seal portions 56, 58, and 60 include respective angled surfaces or faces (e.g., tapered annular surfaces) 62, 64, 66, and 68 that slide past one another. For example, the angled surfaces 62 and 66; and 64 and 68 form respective angled interfaces 69 and 71 (e.g., angled annular interfaces) that slide past each other forcing the first metal seal portion 56, the second metal seal portion 58, and the third metal seal portion 60 radially outward and inward in directions 70 and 72 to form the first and second metal-to-metal seals 52 and 54. In some embodiments, the first and second metal-to-metal seals 52 and 54 may be held (e.g., locked) in place using the lock ring system 50.

The lock ring system 50 and a hydraulic tool 28 operate together to set and lock the seal assembly 34 without rotating the seal assembly 34. As illustrated, the hydraulic tool 28 includes a hydraulic body 78 that couples to a string 30 (e.g., threadingly engages, etc.) at a first end 80, enabling the string 30 to lower and retrieve the hydraulic tool 28 from the wellhead 12. In operation, the string 30 lowers the hydraulic tool 28 until a second end 82 of the hydraulic tool 28 contacts a landing 84 (e.g., axial end surface or abutment) on the hanger 26. In some embodiments, the string 30 or hydraulic body 78 may include one or more protrusions or a ring 86 that blocks removal of the hydraulic tool 28 during use of the hydraulic tool 28. For example, during operation, hydraulic pressure through the string 30 and hydraulic tool 28 may cause the string 30 and hydraulic tool 28 to move axially away from the hanger 26 in axial direction 87. Accordingly, by including one or more protrusions or a ring 86 that contact blowout preventer rams 88, the hydrocarbon extraction system 10 can block retraction of the hydraulic tool 28 while setting the seal assembly 34. In some embodiments, the ring 86 may be removable or integral (e.g., one-piece) with the hydraulic body 78 or the string 30.

The hydraulic tool 28 includes an inner annular piston sleeve 90 and an outer annular piston sleeve 92. The inner and outer annular piston sleeves 90, 92 couple to first and second pistons 94, 96 through apertures 98, 100 in the hydraulic body 78 with connectors 102, 104 (e.g., threaded connectors, pins, etc.). As illustrated, the first and second pistons 94, 96 rest within a counterbore 106 of the hydraulic body 78 that fluidly communicates with a passage 108 in the hydraulic body 78. The first and second pistons 94, 96 may be concentrically arranged with the first piston 94 including a shaft 109 that extends through an aperture 111 in the second piston 96. In this manner, the first and second pistons 94, 96 are exposed to hydraulic pressure in the string 30, enabling the first and second pistons 94, 96 to axially drive the respective inner and outer annular piston sleeves 94, 96 in axial direction 110.

In operation, the first and second pistons 94 and 96 are simultaneously exposed to hydraulic fluid pressure in the string 30. However, because the first and second pistons 94, 96 have different sizes (e.g., have differently sized surfaces areas 113, 115 exposed to the hydraulic pressure), the hydraulic pressure in the string 30 can be adjusted to drive the first and second pistons 94, 96 independently. In other words, the hydraulic tool 28 is able to operate with only fluid flow through the string 30. For example, the first piston 94 may have a diameter 112 that is less than the diameter 114 of the second piston 96. The difference in diameters 112 and 114 and the corresponding differences in areas 113, 115 of the first and second pistons 94, 96 exposes the first and second pistons 94, 96 to different forces. Indeed, because the second piston 96 exposes a larger surface area 115 (e.g., ring-shaped area) to the hydraulic pressure in the string 30, the force on the second piston 96 is greater than that on the surface area 113 of the shaft 109 on the first piston 94. The second piston 96 can therefore move before the first piston 94. As the second piston 96 moves in axial direction 110, the second piston 96 drives the outer annular piston sleeve 92 via the connectors 104 in axial direction 110. As will be explained in detail below, movement of the outer annular piston sleeve 92 sets the seal assembly 34. Once the seal assembly 34 is set, the hydraulic fluid pressure in the string 30 may be increased to drive the first piston 94. Movement of the first piston 94 in axial direction 110 drives the inner annular piston sleeve 90 via the connector 102 in axial direction 110. As the inner annular piston sleeve 90 moves in axial direction 110, the inner annular piston sleeve 90 energizes the positive locking system 50 to lock the seal assembly 34 in an energized or sealed state.

In some embodiments, the hydrocarbon extraction system 10 may include a controller 116 with a memory 117 and processor 118 that controls the operation of a pump 119. In operation, the processor 118 executes instructions stored in the memory 118 to control operation of the pump 119. For example, the controller 116 controls when the hydraulic pressure changes to drive the first and second pistons 94, 96.

Figure 3:
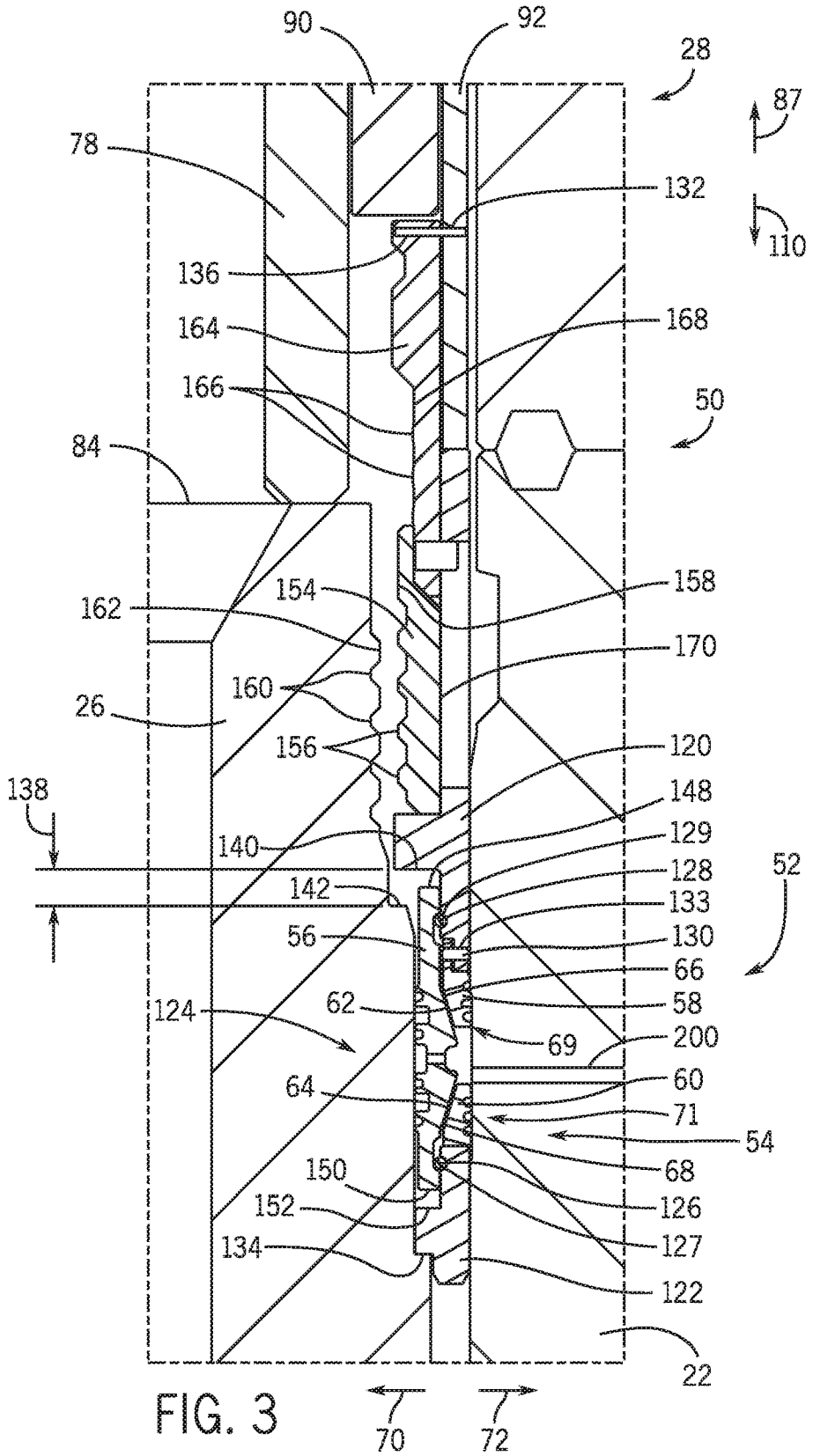
FIG. 3 is a detail view of an embodiment of a lock ring system and an unenergized seal assembly within line 3-3 of FIG. 2.

FIG. 3 is a detail view of FIG. 2 within line 3-3 illustrating an embodiment of the lock ring system 50 in an unlocked position and the seal assembly 34 in an unenergized state. In some embodiments, the seal assembly 34 may include a first seal sleeve 120 and a second seal sleeve 122 positioned axially above and below the first metal seal portion 56, the second metal seal portion 58, and the third metal seal portion 60. In operation, the first seal sleeve 120 and the second seal sleeve 122 facilitate compression and thereby circumferential expansion of the first, second, and third metal seal portions 56, 58, 60.

The seal assembly 34 includes multiple connections 124 (e.g., pins, rings, etc.) that couple and keep the seal assembly 34 together. For example, the seal assembly 34 may include a first ring 126 that fits into an annular recess 127 to couple the second sleeve 122 to the first metal seal portion 56. The seal assembly 34 may also include a second ring 128 that fits into an annular recess 129, and a pin 130 that fits into a radial receptacle 133, in order to couple the respective first metal seal portion 56 and second metal seal portion 58 to the first sleeve 120. The seal assembly 34 may then be lowered into position with the hydraulic tool 28 using a shear structure 132 (e.g., a shear pin) that fits into a radial receptacle 136 that couples the outer sleeve 92 to the first seal sleeve 120.

In operation, the hydraulic tool 28 lowers the seal assembly 34 until the second sleeve 122 contacts a seal landing 134 (e.g., circumferential ledge on the hanger 26) on the tubing hanger 26. In some embodiments, the seal landing 134 may be a ledge (e.g., circumferential lip, shoulder, or abutment) formed on the casing spool 22 or another tubular within the hydrocarbon extraction system 10. After lowering the seal assembly 34 and the lock ring system 50, the hydraulic tool 28 activates the outer annular piston sleeve 92 driving the outer annular piston sleeve 92 an axial distance 138 until a lip 140 (e.g., annular lip) on the first seal sleeve 120 contacts a ledge 142 (e.g., annular ledge) on the tubing hanger 26.

As the first sleeve 120 moves axially in direction 110, the first seal sleeve 120 axially drives the second metal seal portion 58 as well as the first metal seal portion 56. For example, the first seal sleeve 120 uses the ledge 142 (e.g., circumferential ledge) to contact a top surface 148 of the first metal seal portion 56 driving the first metal seal portion 56 in axial direction 110. The movement of the first metal seal portion 56 in axial direction 110 drives the angled surface 64 on the first metal seal portion 56 into contact with the angled surface 68 on the third metal seal portion 60. The surfaces 64 and 68 may be tapered or curved annular surfaces, or conical surfaces. As the angled surface 64 slides over the angled surface 68, the angled interface 71 (e.g., tapered or curved annular interface) drives the first metal seal portion 56 radially inward in radial direction 70 and drives the third metal seal portion 60 radially outward in radial direction 72 to form the second seal 54 between the casing spool 22 and the hanger 26. While the second seal 54 forms, the first seal sleeve 120 continues to move in axial direction 110 driving the first metal seal portion 56 and the second metal seal portion 58 in axial direction 110. Eventually, the first metal seal portion 56 stops moving in axial direction 110 due to compression between the first metal seal portion 56 and the third metal seal portion 60 or because of contact between a bottom surface 150 and ledge 152 on the second seal sleeve 122. Once the first metal seal portion 56 stops moving, the first seal sleeve 120 is able to drive the angled surface 66 of the second metal seal portion 58 into contact with the angled surface 62 (e.g., tapered or curved annular surface) on the first metal seal portion 56. As the angled surface 66 (e.g., tapered or curved annular surface) slides past the angled surface 62, the angled interface 69 (e.g., tapered or curved annular surface) drives the first metal seal portion 56 radially inward in radial direction 70 and drives the second metal seal portion 58 radially outward in radial direction 72, thus forming the first seal 52 between the casing spool 22 and the hanger 26.

While the first seal sleeve 120 forms the first and second seals 52, 54, the axial movement of the first seal sleeve 120 in axial direction 110 aligns a load ring 154 with the tubing hanger 26. For example, the first radial lock feature on the load ring 154 (e.g., split ring or c-ring) may include multiple protrusions and recesses (e.g., axially spaced annular protrusions or teeth) on a surface 158 that correspond to the second radial lock feature 160 (e.g., axially spaced annular recesses and protrusions) on a surface 162 of the tubing hanger 26. Accordingly, movement of the first seal sleeve 120 in axial direction 110 enables the first radial lock feature 156 to align with the second radial lock feature 160, while simultaneously energizing the seal assembly 34.

In order to maintain the seal assembly 34 in an energized state, the inner annular piston sleeve 90 drives the lock ring system 50 into a locked position without rotation (e.g., axial translation). The lock ring system 50 includes the load ring 154 and a lock ring 164. In operation, the load ring 154 couples to the tubing hanger 26 in order to resist movement of the seal assembly 34. Specifically, the first radial lock feature 156 on the surface 158 resists axial movement in axial direction 87 after engaging the second radial lock feature 160 on surface 162 of the tubing hanger 26. In order to maintain engagement between the load ring 154 and the tubing hanger 26, the hydraulic tool 28 axially drives the lock ring 164 behind the load ring 154 (e.g., in an axially overlapping relationship). In some embodiments, the lock ring 164 may include protrusions 166 (e.g., axially spaced annular protrusions or teeth) on a surface 168 that may remove a gap between the surfaces 168 and 170 as well as increase pressurized contact between the lock ring 164 and the load ring 154, which resists movement of the lock ring 164 in direction 87. In other embodiments, the load ring 154 may include the protrusions 166 on the surface 170 to increase pressurized contact between the lock ring 164 and the load ring 154.

Figure 4:
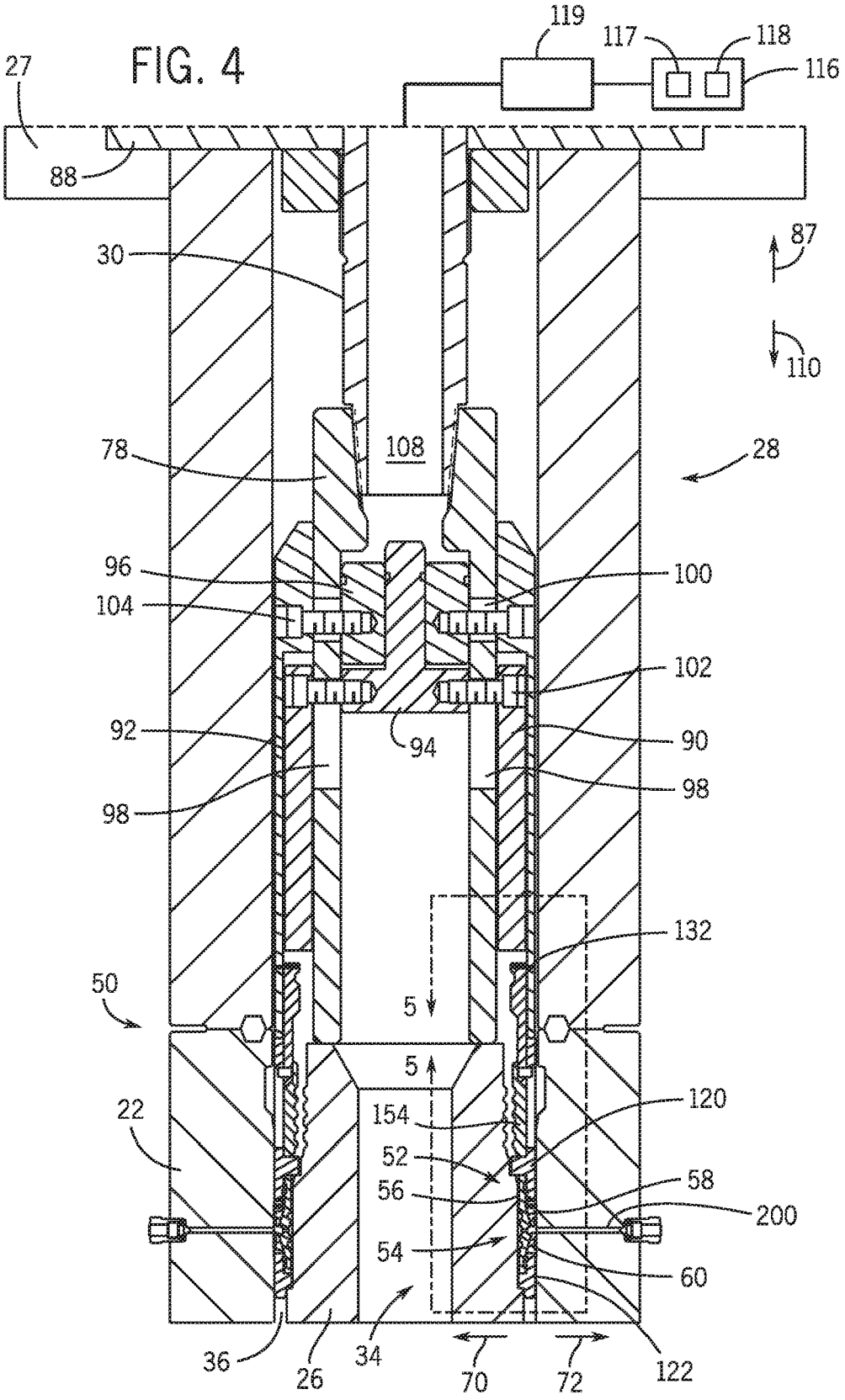
FIG. 4 is a cross-sectional side view of a hydraulic tool with an energized first piston and an energized seal assembly.

FIG. 4 is a cross-sectional side view of the hydraulic tool 28 energizing the seal assembly 34. As explained above, in order to energize the seal assembly 34, hydrocarbon extraction system 10 pumps hydraulic fluid into the drilling string 30 to drive the second piston 96 in axial direction 110. As the second piston 96 moves in axial direction 110, the second piston 96 drives the outer annular piston sleeve 92 via the connectors 104 in axial direction 110. The movement of the outer annular piston sleeve 92 in direction 110 enables the outer annular piston sleeve 92 to energize the seal assembly 34.

Figure 5:
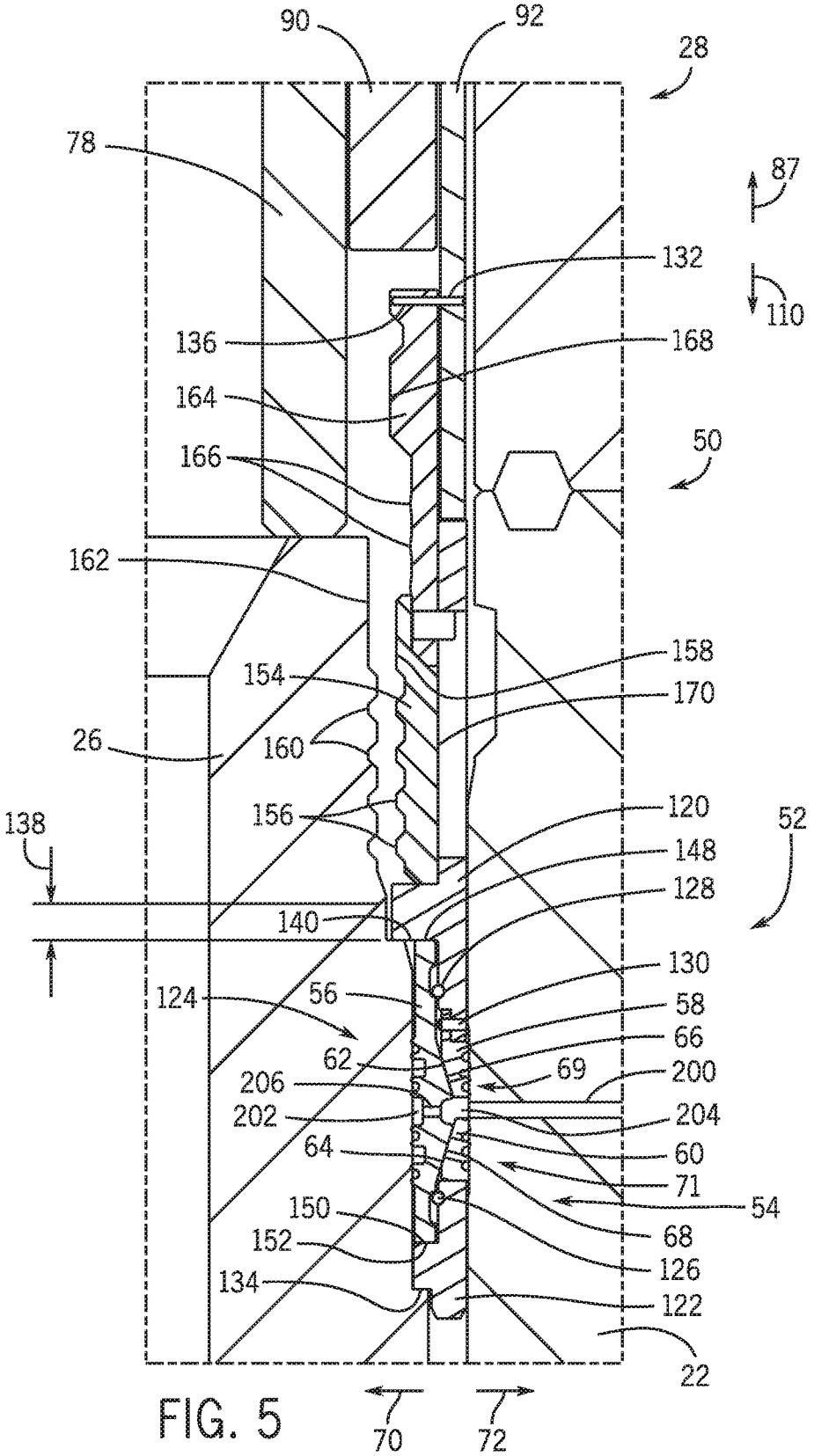
FIG. 5 is a detail view of an embodiment of a lock ring system and the energized seal assembly within line 5-5 of FIG. 4.

FIG. 5 is a detail view of FIG. 4 within line 5-5 illustrating the seal assembly 34 in an energized state. As explained above, the second piston 96 drives the outer annular piston sleeve 92. The movement of the outer annular piston sleeve 92 in turn drives the first seal sleeve 120 in direction 110 the distance 138. As the first seal sleeve 120 moves in direction 110, the first seal sleeve 120 drives the first metal seal portion 56 and the second metal seal portion 58 to form the first seal 52 and the second seal 54. As explained above, the angled interfaces 69 and 71 enable the first metal seal portion 56 to move radially inward in radial direction 70, while the second and third metal seal portions 58, 60 move radially outward in radial direction 72. Furthermore, as the first seal sleeve 120 moves in direction 110, the load ring 154 aligns with the tubing hanger 26. As explained above, the load ring 154 may include the first radial lock feature 156 that enables the load ring 154 to couple (e.g., lock) to the tubing hanger 26. Accordingly, as the first seal sleeve 120 moves in axial direction 110, the first radial lock feature 156 on the load ring 154 aligns with the second radial lock feature 160 on the hanger 26.

Once the first and second seals 52, 54 are set, fluid may be pumped through a passage 200 (e.g., test port) in the casing spool 22 to test the first and second seals 52, 54. In operation, a pressurized fluid is pumped through the casing spool 22 and into first and second seal test chambers 202, 204 to check for proper sealing of the first, second, and third metal seal portions 56, 58, 60. In some embodiments, the first metal seal portion 56 may include an aperture 206 that connects the first and second seal test chambers 202, 204, enabling a single passage 200 (e.g., test port) to test the seal assembly 34.

Figure 6:
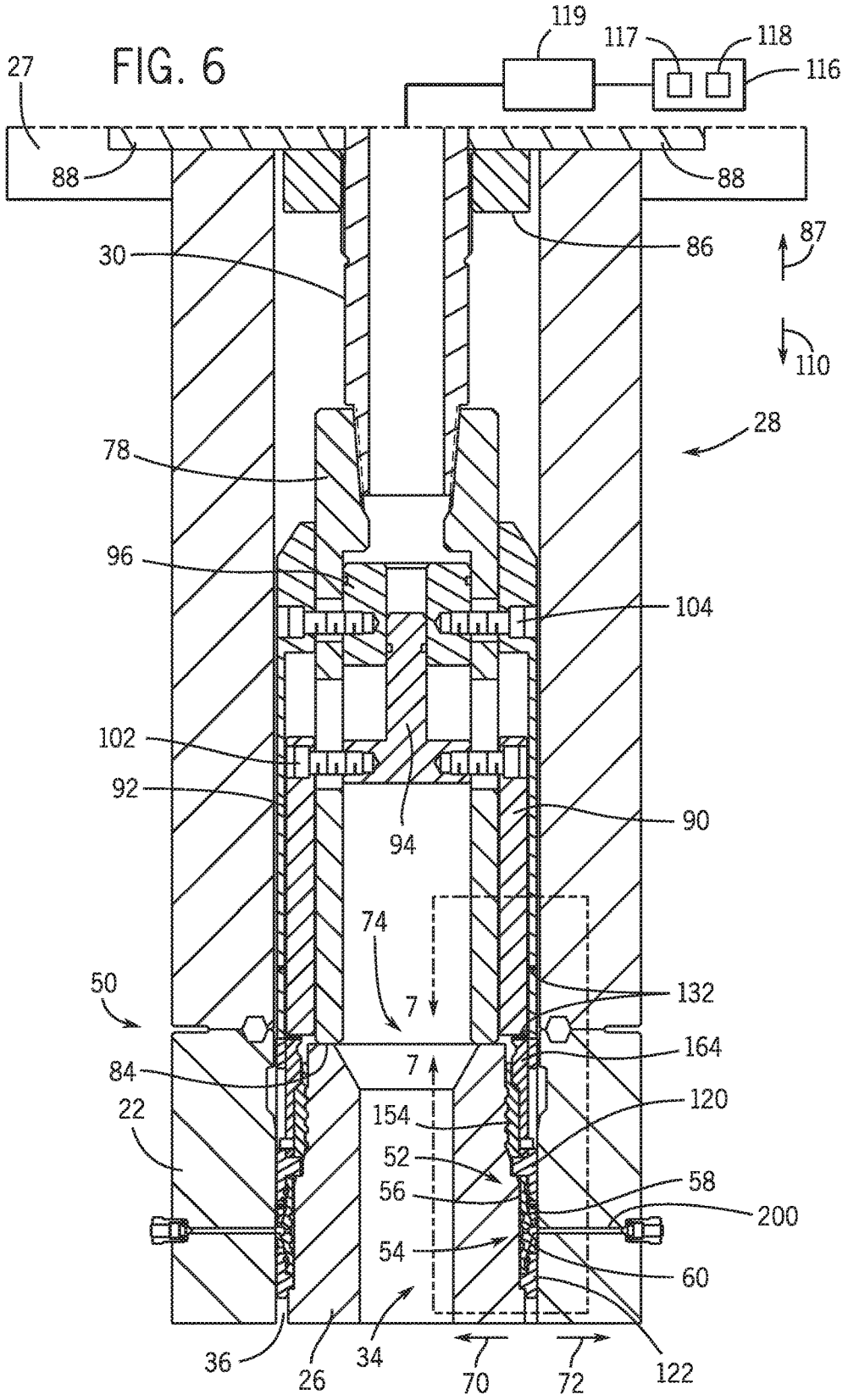
FIG. 6 is a cross-sectional side view of an energized hydraulic tool, seal assembly, and lock ring system.

FIG. 6 is a cross-sectional view of an embodiment of an energized lock ring system 50. In order to energize the lock ring system 50, the pressure of the hydraulic fluid in string 30 is increased to increase the force on the first piston 94. The increase in force then drives the first piston 94 in axial direction 110. As the first piston 94 moves in axial direction 110, the first piston 94 drives the lock ring 164, which shears through the shear pin 132. The lock ring 164 then moves circumferentially behind the load ring 154 (e.g., axially overlapping) to energize the positive locking system 50 and thereby lock the seal assembly in an energized or sealed state.

Figure 7:
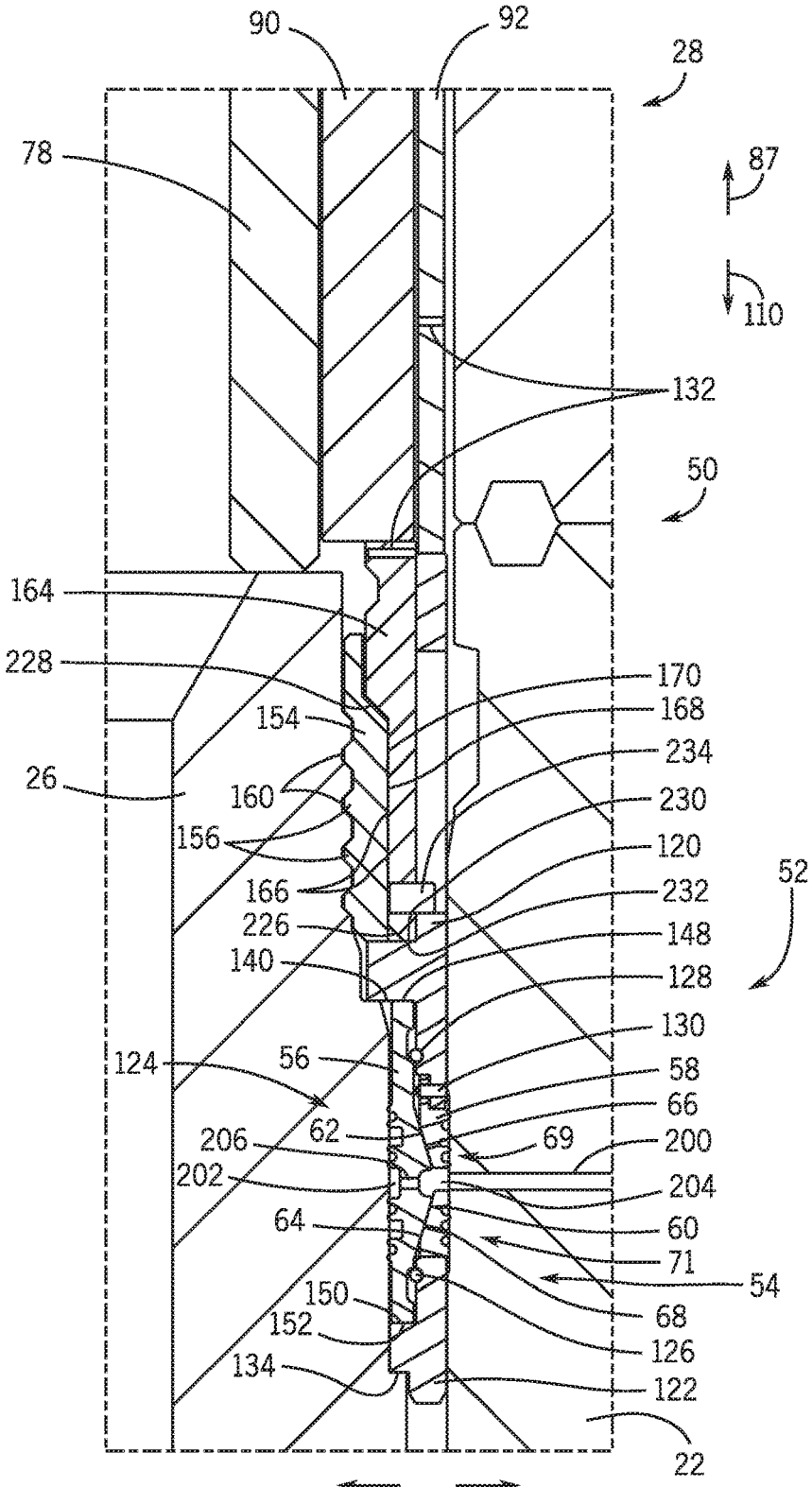
FIG. 7 is a detail view of an embodiment of the lock ring system in a locked position and the energized seal assembly within line 7-7 of FIG. 6.

FIG. 7 is a detail view of FIG. 6 within line 7-7 of an embodiment of the energized lock ring system 50. As explained above, the lock ring system 50 includes the load ring 154 and the lock ring 164. In operation, the load ring 154 couples to the tubing hanger 26 in order to resist movement of the seal assembly 34. In order to maintain engagement between the load ring 154 and the tubing hanger 26, the hydraulic tool 28 drives inner annular piston sleeve 90 in substantially direction 110, which moves the lock ring 164 circumferentially behind the load ring 154 (e.g., axially overlapping). More specifically, as the lock ring 164 moves in substantially direction 110, an angled contact surface 226 (e.g., tapered annular surface) on the lock ring 164 contacts a corresponding angled surface 228 (e.g., tapered annular surface) on the load ring 154. The contact between the two angled surfaces 226 and 228 forces the load ring 154 radially inward in radial direction 70, which couples the load ring 154 to the hanger 26. As explained above, the load ring 154 may couple to the tubing hanger 26 with a first radial lock feature 156, which includes protrusions and recesses on the surface 158 that correspond to a second radial lock feature 160, which includes protrusions and recesses on the surface 162 of the tubing hanger 26. After coupling the load ring 154 to the tubing hanger 26, the inner annular piston sleeve 90 will continue driving the lock ring 164 in axial direction 110 until the bottom surface 230 of the lock ring 164 contacts a top surface 232 of the first seal sleeve 120. In this position, the lock ring 164 blocks radial movement of the load ring 154, while the first radial lock feature 156 on the load ring blocks/resists axial movement in direction 87. In some embodiments, a guide pin 234 may couple the lock ring 164 to the first seal sleeve 120 to guide and align (e.g., axially guides) the lock ring 164 as the inner annular piston sleeve 90 axially drives the lock ring 164. Furthermore, in some embodiments, the lock ring 164 may include protrusions 166 on the surface 168. These protrusions 166 may increase pressurized contact between the lock ring 164 and the load ring 154 to resist axial movement of the lock ring 164 in direction 87.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a hydraulic tool configured to energize a first component and a second component with a hydraulic fluid, wherein the hydraulic tool comprises:

a hydraulic body configured to couple to a hydraulic fluid source;

a first piston configured to move axially with respect to the hydraulic body to energize the first component; and a second piston configured to move axially with respect to the hydraulic body to energize the second component;

wherein the first and second pistons are simultaneously exposed to the hydraulic fluid in an opening in the hydraulic body to energize the first and second components, respectively, wherein the first piston has a first surface area configured to contact the hydraulic fluid and the second piston has a second surface area configured to contact the hydraulic fluid, and wherein the first and second surface areas are different from one another.

2. The system of claim 1, wherein the first and second surface areas being different from one another is configured to enable the hydraulic fluid to apply different first and second forces on the first and second pistons, respectively, in response to the hydraulic fluid.

3. The system of claim 2, wherein the second surface area is greater than the first surface area, and the second force is greater than the first force.

4. The system of claim 1, wherein the first and second pistons are configured to be actuated independent from one another in response to the hydraulic fluid, a first hydraulic fluid pressure drives the second piston and not the first piston, a second hydraulic fluid pressure drives the first piston, and the first hydraulic fluid pressure is less than the second hydraulic fluid pressure.

5. The system of claim 1, wherein the first and second pistons rest within a counterbore of the hydraulic body along an axis of the hydraulic tool, and the hydraulic tool is configured to be run into a bore of a tubular in a direction along a central axis of the tubular.

6. The system of claim 1, wherein the first piston couples to an inner annular piston sleeve, and the second piston couples to an outer annular piston sleeve.

7. The system of claim 1, wherein the first piston couples to the first component with a first shear pin, or the second piston couples to the second component with a second shear pin, or a combination thereof.

8. The system of claim 1, wherein the first component comprises a lock.

9. The system of claim 1, wherein the second component comprises a seal.

10. A system, comprising:

a tool configured to energize a first component and a second component with a fluid, wherein the tool comprises:

a body configured to couple to a fluid source;

a first piston configured to move axially with respect to the body to energize the first component; and a second piston configured to move axially with respect to the body to energize the second component;

wherein the first and second pistons are simultaneously exposed to the fluid to energize the first and second components, respectively, wherein at least a portion of the first piston is disposed in an aperture in the second piston, and wherein the first and second pistons are configured to be actuated independent from one another in response to the fluid.

11. The system of claim 10, wherein the tool is configured to be run into a tubular along a central axis, and the first and second pistons are configured to move in a direction along the central axis when the tool is disposed in the tubular.

12. The system of claim 11, comprising a hydrocarbon extraction system having the tubular.

13. The system of claim 10, wherein the portion of the first piston comprises a shaft disposed within the aperture in the second piston.

14. The system of claim 10, wherein the first piston has a first surface area in contact with the fluid and the second piston has a second surface area in contact with the fluid, and wherein the second surface area is larger than the first surface area.

15. The system of claim 10, wherein a first fluid pressure drives the second piston and not the first piston, a second fluid pressure drives the first piston, and the first fluid pressure is less than the second fluid pressure.

16. The system of claim 10, wherein the first component comprises a lock.

17. The system of claim 10, wherein the second component comprises a seal.

18. A method, comprising:

operating a hydraulic tool to energize first and second components, comprising:

selectively moving a first piston with a first area and a second piston with a second area, wherein the first and second areas are simultaneously exposed to a hydraulic fluid through an opening in a hydraulic body, and wherein the first and second pistons are moved axially with respect to the hydraulic body in response to the hydraulic fluid to energize the first and second components, respectively, wherein the first and second surface areas are different from one another.

19. The method of claim 18, wherein selectively moving comprises independently moving the first and second pistons in response to the hydraulic fluid.

20. The method of claim 18, comprising applying different first and second forces on the first and second pistons, respectively, in response to the hydraulic fluid and the first and second surface areas being different from one another, wherein the second surface area is greater than the first surface area, and the second force is greater than the first force.

* * * * *